United States Patent [19]

Matsutani et al.

[11] 4,321,432

[45] Mar. 23, 1982

[54] ELECTROSTATIC MICROPHONE

[75] Inventors: Hideki Matsutani; Hiroto Wada, both of Yokohama, Japan

[73] Assignee: Tokyo Shibaura Denki Kabushiki Kaisha, Kawasaki, Japan

[21] Appl. No.: 104,066

[22] Filed: Dec. 17, 1979

[30] Foreign Application Priority Data

Dec. 23, 1978 [JP] Japan ..... 53/160711
Dec. 23, 1978 [JP] Japan ..... 53/160719

[51] Int. Cl.[3] ..... H04R 19/04
[52] U.S. Cl. ..... 179/111 R
[58] Field of Search ..... 179/111 R, 111 E

[56] References Cited

U.S. PATENT DOCUMENTS

| | | | |
|---|---|---|---|
| 3,300,585 | 1/1967 | Reedyk et al. | 179/111 R |
| 3,740,496 | 6/1973 | Carlson et al. | 179/111 E |
| 3,775,572 | 11/1973 | Ishibashi et al. | 179/111 R |
| 3,946,422 | 3/1976 | Yagi et al. | 179/111 E |
| 3,963,881 | 6/1976 | Fraim et al. | 179/111 E |
| 4,081,626 | 3/1978 | Muggli et al. | 179/111 R |
| 4,170,721 | 10/1979 | Ishibashi et al. | 179/111 R |
| 4,188,513 | 2/1980 | Morrell et al. | 179/111 E |

FOREIGN PATENT DOCUMENTS

| | | | |
|---|---|---|---|
| 368900 | 4/1924 | Fed. Rep. of Germany | 179/111 R |
| 884516 | 6/1953 | Fed. Rep. of Germany | 179/111 R |
| 2909065 | 9/1979 | Fed. Rep. of Germany | 179/111 E |
| 45-25826 | 8/1970 | Japan | 179/111 R |
| 46-38680 | 11/1971 | Japan | 179/111 R |
| 52-2425 | 1/1977 | Japan | 179/111 E |

OTHER PUBLICATIONS

*Telesis,* Nov. 1967, pp. 22–26, "Electret Telephone Transducers", Reedyk.

*Primary Examiner*—George G. Stellar
*Attorney, Agent, or Firm*—Cushman, Darby & Cushman

[57] ABSTRACT

A condenser microphone includes a diaphragm, a stationary electrode and a supporting member which supports the diaphragm and the electrode in spaced parallel relationship. The supporting member is provided with an inner annular projection adapted to support the stationary electrode and an outer annular projection for supporting the diaphragm. An air chamber is defined between the inner and outer annular projections and communicated with an air gap between the diaphragm and the stationary electrode at the periphery of the air gap.

21 Claims, 10 Drawing Figures

ELECTROSTATIC MICROPHONE

This invention relates to an electrostatic mirophone.

Various types of miniature electrostatic microphones or condenser microphones are known. For example, a condenser microphone has been well known which contains, as shown in FIG. 1, a circuit device including an impedance converting element. The condenser microphone shown in FIG. 1 is provided with an electrically conductive cylindrical casing 2 having a sound receiving plate 4 formed with a plurality of perforations. Disposed in the casing 2 is a supporting member 6 having a recess formed to receive an acoustically resistive member 8 on the upper surface confronting the sound receiving plate 4 and a cylindrical side wall 10 on the lower side for supporting a printed circuit board 12. A stationary electrode 14 prepared by forming a plastic film on a metal plate and processing the plastic film to form a electret film and formed with a plurality of pefo-rations is secured to the supporting member 6 and the acoustically resistive member 8. A diaphragm 16 is mounted in parallel with the sound receiving plate 4 and the stationary electrode 14 with the periphery of the diaphragm clamped between an insulation spacer 18 and an electrically conductive ring 20 secured to the inner wall of the casing 2. The diaphragm is formed of a metal diaphragm, for example, titanium having a thickness of several microns.

A circuit device 22 including an impedance converting element, etc. is mounted on the printed circuit board 12. The supporting member 6 is also provided with a plurality of perforations aligned with the perforations of the stationary electrode 14 at the bottom of the recess for receiving the acoustically resistive member 8. With this construction, the vibration of the diaphragm 16 is transmitted to an air chamber 24 defined by the cylindrical side wall 10 of the supporting member 6 and the printed circuit board 12 through the perforations of the stationary electrode 14, the acoustically resistive member 8 and the perforations of the supporting member, so that the diaphragm 16 can vibrate relatively freely in response to sound supplied thereto through the sound receiving plate 4. In other words, in response to an input sound pressure, the diaphragm 16 vibrates at a relatively high sensitivity so as to vary at high sensitivity the capacitance of a capacitor constituted by the diaphragm 16 and the stationary electrode 14. The lower opening of the casing 2 is closed by a lid 25.

The cylindrical side wall 10 of the supporting member 6 is provided with opposing perforations 26 and 28 and perforations 30 and 32 are provided through the side wall of the casing 2 in alignment with perforations 26 and 28. Where these perforations 26, 28, 30 and 32 are provided the condenser microphone manifests unidirectivity, and on the other hand, where these perforations and the acoustically resistive member 8 are eliminated the microphone becomes nondirective.

For the purpose of brevity, in FIG. 1, wirings between the stationary electrode, the printed circuit board 12, the circuit device 2 and the external circuit are not shown.

Although the condenser microphone shown in FIG. 1 is satisfactory for its small size, there still remains certain problems from the standpoints of its operational characteristics, manufacturing process and cost.

More particularly, provision of perforations for the stationary electrode 14 often results in fins and warping which degrade the operating characteristics of the condenser microphone. Further, the provision of perforations through the stationary electrodes 14 decreases its effective area thus decreasing the rate of capacitance variation caused by the vibration of the diaphragm. In addition, use of the spacer 18 further decreases the effective area of the stationary electrode and increases the number of manufacturing steps and the cost.

For the purpose of imparting unidirectivity to the condenser microphone, perforations 26, 28, 30 and 32 are formed and an acoustically resistive member made of paper or cloth to keep the dust off is used. However, it is difficult to dispose the supporting member 6 in the casing 2 so as to align the perforations 26 and 28 and the perforations 28 and 32. Further, since the acoustically resistive member 8 is secured to the supporting member 6 with a bonding agent, it becomes difficult to maintain the stationary electrode 14 and the diaphragm 16 in perfect parallel relationship because of the variations in quantity of the bonding agent and in thickness of the acoustically resistive member 8. Usually unidirectivity can be obtained by cancelling with each other sound signals having a phase different of 180° but in the microphone shown in FIG. 1, the unidirectivity can be attained by cancelling with each other sound signals having a phase difference of 90° so that full satisfaction for the unidirectivity can not be obtained.

Accordingly, it is an object of this invention to provide an improved electrostatic microphone which can be manufactured with simple manufacturing steps and can use efficiently a stationary electrode.

According to this invention, there is provided an electrostatic microphone comprising an electroconductive diaphragm, a stationary electrode plate, a supporting member for supporting the diaphragm substantially in parallel with the stationary electrode plate, and means for defining an air chamber communicated with an air gap between the vibrating diaphragm and the stationary electrode plate at the peripheral portion of said air gap.

Figure 1:
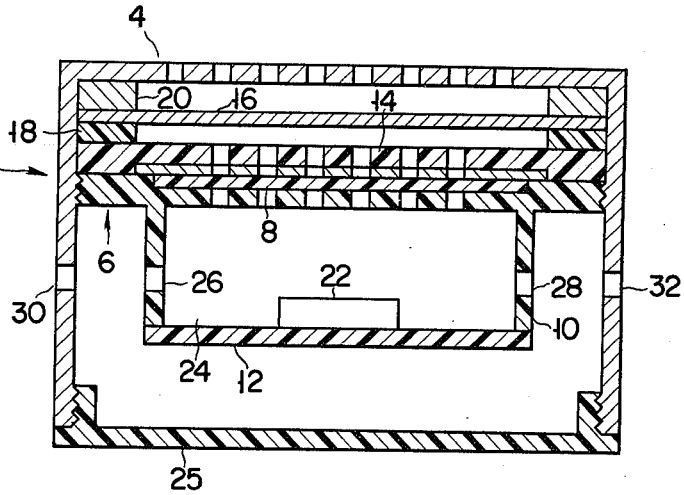
FIG. 1 PRIOR ART
FIG. 1 is a cross-sectional view showing one example of a prior art condenser microphone.
Figure 2:
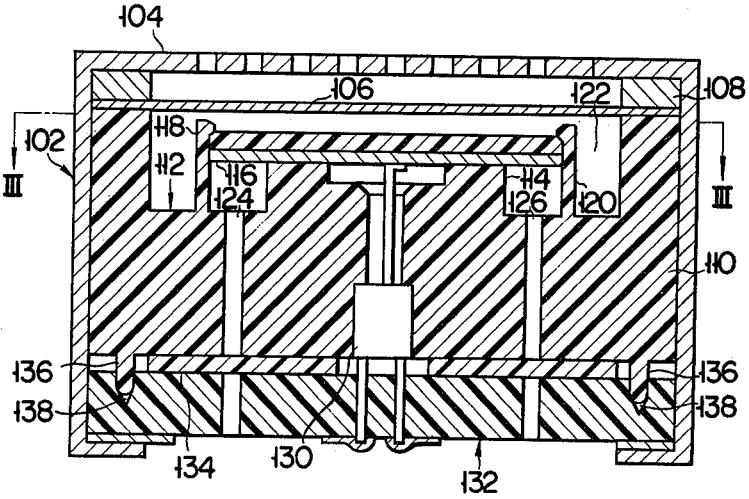
FIG. 2 is a cross-sectional view showing one example of a condenser microphone embodying the invention.
Figure 3:
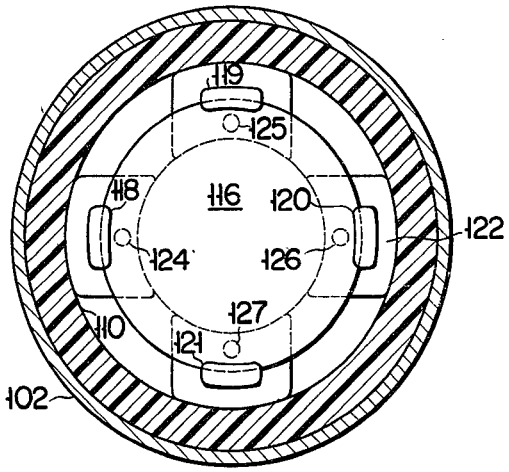
FIG. 3 is a cross-sectional view of the condenser microphone shown in FIG. 2 taken along a line III—III.

A condenser microphone shown in FIGS. 2 and 3 includes a casing 102 made of metal such as aluminum and having an outer diameter of about 10 mm and top portion formed with a plurality of perforations and acting as a sound receiving section 104. Inside of the metal casing 102 is held a diaphragm 106 made of electrically conductive film such as aluminum film to oppose the sound receiving section 104 with the periphery clamped between an electrically conductive ring 108 and an outer annular projection 110 of an insulative supporting member 112. The electrically conductive ring 108 is fitted in the casing 102 for electrically coupling the casing 102 and the diaphragm 106. The supporting member 112 is provided with an inner annular projection 114 adapted to support a stationary electrode 116 formed by disposing a plastic film on a metal plate and processing the plastic film to form an electret film, for example, and four resilient supporting fingers 118 to 121 which have top pins acting to urge the stationary electrode 116 toward the inner annular projection 114 thus firmly securing the stationary electrode 116. The annular projections 110 and 114 are designed to hold the diaphragm 106 and the stationary electrode 116 with a predetermined space, for example, 0.1 mm. The diaphragm 106, the supporting member 112 and the stationary electrode 116 cooperate to define an air chamber 122 which permits the diaphragm 106 to vibrate relatively freely.

The supporting member 112 is further provided with four longitudinally extending through holes 124 to 127 communicated with the air chamber 122 for imparting unidirectivity to the condenser microphone and a recess for receiving a circuit device 130 containing a field effect transistor acting as an impedance converting element. The electric circuit device 130 is forcedly fitted into and resiliently held in the recess. The gate electrode of the field effect transistor in the circuit device 130 extends in the longitudinal direction to engage with the rear surface or the metal vapor-deposited surface of the stationary electrode 116 thus establishing an electrical contact thereto. The source and drain electrodes of the field effect transistor are coupled to a patterned circuit formed on a printed circuit board 132 through perforations formed therein. The printed circuit board 132 is provided with further perforations communicated with perforations 124 to 126 of the supporting member 112 via an acoustically resistive member 134 clamped between the supporting member 112 and the printed circuit board 132 to keep the dust off. The supporting member 112 and the printed circuit board 132 are held in a predetermined positional relationship by inserting pins 136 at the bottom of the supporting member 112 into recesses 138 of the printed circuit board 132.

The lower end of the casing 102 is bent inwardly to firmly hold the diaphragm 106, the supporting member 112 and the printed circuit board 132 in a predetermined positional relationship and to make electrical contact with the patterned ground terminal of the printed circuit board 132.

Figure 4:
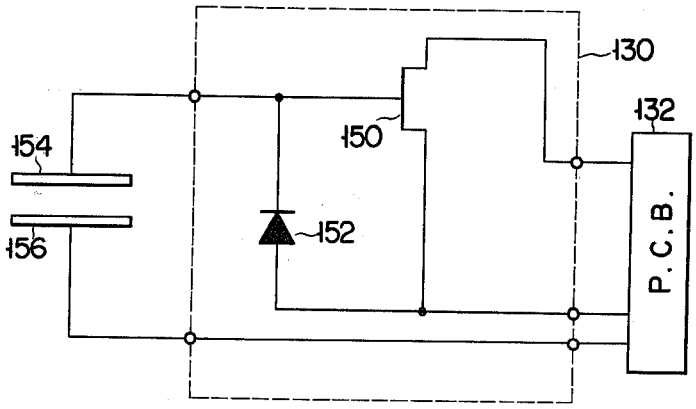
FIG. 4 is an electrical circuit of the condenser microphone shown in FIGS. 2 and 3.

As shown in the electrical circuit of FIG. 4 corresponding to the condenser microphone shown in FIGS. 2 and 3, the circuit device 130 includes a field effect transistor 150 and a diode 152 connected between the source and gate electrodes of the field effect transistor. Further, the gate electrode of the field effect transistor 150 is connected to a first electrode 154 corresponding to the stationary electrode 116. The first electrode 154 and a second electrode 156 corresponding to the diaphragm 106 form a capacitor whose capacitance varies in accordance with the vibration of the diaphragm 106. The drain and source electrodes of the field effect transistor 150 and the second electrode 156 are electrically coupled with three different terminals of the printed circuit board 132. The FET 150 functions to convert high impedance output from the capacitor formed of the first and second electrodes 154 and 156 to a low impedance output so that the condenser microphone is made free from induction noise caused by an external circuit (not shown).

It should be particularly noted that the stationary electrode 116 of the condenser microphone shown in FIGS. 2 and 3 is not provided with any perforation and the air chamber 122 is formed in the supporting member 112 near the peripheral portion of the stationary electrode 116 so that the air chamber 122 can be easily communicated with an air gap between the vibrating diaphragm 106 and the stationary electrode 116 at the peripheral portion of the air gap. Further, the stationary electrode 116 is disposed to face the effective vibrating portion of the diaphragm 106 thereby attaining effecient use of the entire surface of the stationary electrode and increasing the effective area of the diaphragm 106.

Where an electret is used to prepare the stationary electrode 116, the electret does not contact at substantially any portion with other component elements so that it is possible to maintain the density of charge induced on the surface thereof at a uniform value.

The supporting member 112 is molded from an insulating materail. The stationary electrode 116 is placed on the supporting member 112 and the circuit device 130 is forcedly put into the supporting member 112. Then, the supporting member 112 with the stationary electrode 116 and the circuit device 130 held therein is put into the casing 102 which has already received the metal ring 108 and the vibrating diaphragm 106. Next, the acoustically resistive member 134 and the printed circuit board 132 are received into the casing 102 in a predetermined positional relationship to the supporting member 112. Thus, the condenser microphone shown in FIGS. 2 and 3 can be fabricated relatively easily.

Figure 5:
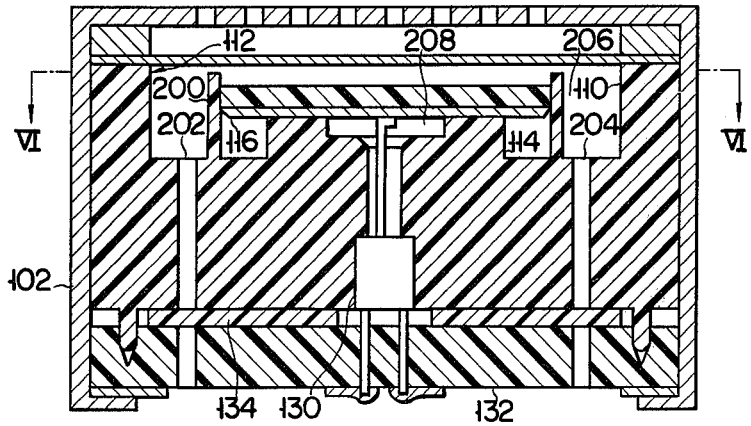
FIG. 5 is a longitudinal cross-sectional view showing a modified condenser microphone embodying the invention.
Figure 6:
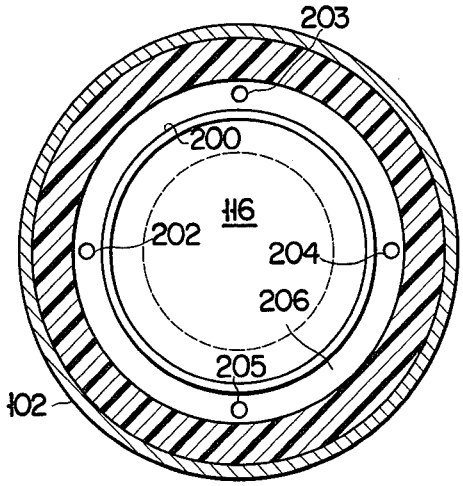
FIG. 6 is a cross-sectional view of the condenser microphone shown in FIG. 5 taken along a line VI—VI.

FIGS. 5 and 6 illustrate another embodiment of the condenser microphone according to this invention in which elements corresponding to those shown in FIGS. 2 and 3 are designated by the same reference numerals. The modified embodiment shown in FIGS. 5 and 6 is identical to the first embodiment shown in FIGS. 2 and 3 except that a supporting ring 200 is substituted for the supporting fingers 118 to 121 for supporting the stationary electrode 116 and that the perforations 202 and 205 for imparting to the condenser microphone unidirectivity are formed to be communicated with an air chamber 206 between the supporting ring 200 and the outer annular projection 110.

To secure the stationary electrode 116 to the supporting member 112, a slightly excessive amount of an electroconductive bonding agent is poured into a recess 208 within the inner annular projection 114 of the supporting member 112, and thereafter the stationary electrode 116 is mounted on the top of the inner annular projection 114. Then a portion of the bonding agent in the recess 208 is pushed out into a space between the stationary electrode 116 and the inner annular projection 114 thus firmly bonding the stationary electrode 116 to the supporting member 112. At this time, the gate electrode of a field effect transistor of the circuit device 130 would be firmly bonded electrically to the stationary electrode 116.

While the invention has been described with reference to preferred embodiments, it should be understood that the invention is not limited to these specific embodiments.

Figure 7:
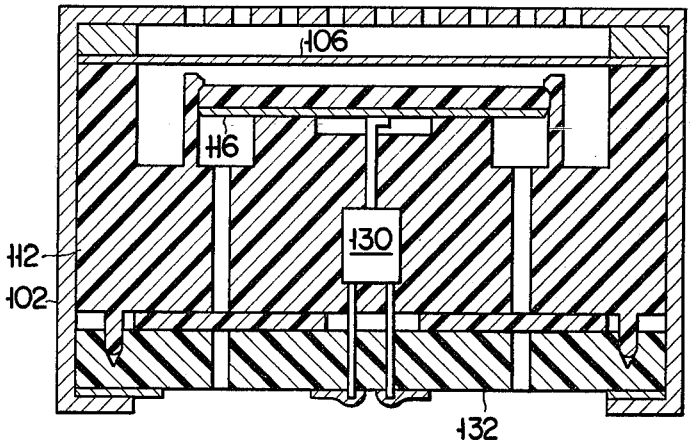
FIG. 7 is a cross-sectional view showing still another embodiment of this invention.

For example, in these embodiments, although the circuit device 130 was contained in the recess of the supporting member 112, the circuit device 130 may be embedded in the supporting member 112 as shown in FIG. 7. In this case, it is possible to form the supporting member 112 integrally with a housing of the circuit device 130. Furthermore, the circuit device 130 may be eliminated by interconnecting the stationary electrode 116 and the printed circuit board 132 with a single lead wire and by connecting an external circuit device to the printed circuit board 132.

Figure 8:
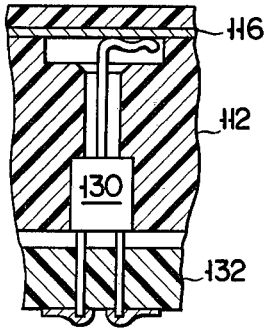
FIG. 8 is a fragmentary cross-sectional view showing a modification of the circuit device utilized in the condenser microphones shown in FIGS. 2 to 6.

Furthermore, in the embodiment shown in FIG. 2, the gate electrode of the field effect transistor in the circuit device 130 may be made of a flexible material, while the source and drain electrodes may be made of rigid material. As shown in FIG. 8, where a wavy resilient material is used for the lead wire of the gate electrode, more good electrical contact can be formed between the gate electrode and the stationary electrode 116 and the spring force of the lead wire urges the stationary electrode against the supporting fingers 118 to 121 (See FIG. 3.) whereby the stationary electrode 116 can be held more securely.

Figure 9:
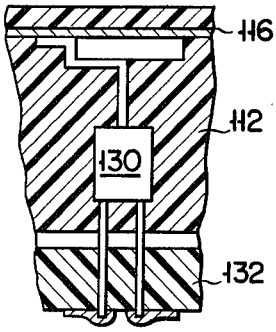
FIG. 9 is a fragmentary cross-sectional view showing a modification of the circuit device utilized in the condenser microphone shown in FIG. 7.

The gate lead wire of the circuit device 130 may be bonded to the side wall of the supporting member 112 as shown in FIG. 9. This construction is suitable because the lead wire can be embedded in the supporting member 112 when it is molded to surround the circuit device 130. With this construction, good electrical contact can be ensured between the stationary electrode 116 and the gate lead wire.

Figure 10:
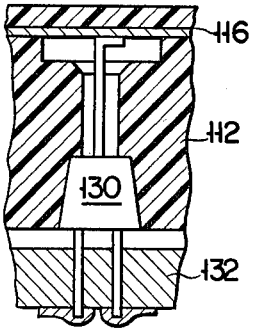
FIG. 10 is a fragmentary cross-sectional view showing a modification of the circuit device utilized in the condenser microphone shown in FIGS. 2 to 6.

While in the embodiments shown in FIGS. 2 to 6, the circuit device 130 is received in the recess of the supporting member 112, an air gap which may be formed between the circuit device 130 and the supporting member 112 due to dimensional error of the recess so that the vibrating energy of the vibrating diaphragm 106 would leak through this air gap. This problem can be solved by shaping a housing of the circuit device 130 to have a frustum configuration as shown in FIG. 10 and by forming the recess for accomodating the circuit device to have a corresponding tapered configuration. The condenser microphone shown in the foregoing embodiments may be made to be nondirective by eliminating the communicating perforations 124 to 127 or 202 to 205, in which case it is not necessary to provide perforations through the printed circuit board 132.

Further, the vibrating diaphragm 106 can be formed by vapor-depositing metal on a dielectric high polymer film such as polypropylene or tetrafluoro ethylene film.

What we claim is:

1. An electrostatic microphone comprising:

an electrically conductive diaphragm, a stationary electrode plate, a supporting member including a central projection upon which said stationary electrode plate is mounted, at least a pair of resilient supporting members which are disposed on opposite sides of said stationary electrode plate for holding the same in cooperation with said central projection, and an annular projection surrounding said central projection and adapted to support said electrically conductive diaphragm, said central and annular projections defining an air chamber communicated with an air gap between said electrically conductive diaphragm and said stationary electrode plate at the peripheral portion of said air gap.

2. The electrostatic microphone according to claim 1 which further comprises a circuit device including impedance converting means which is electrically connected to said stationary electrode plate and converts a high impedance of a capacitor constituted by said diaphragm and said stationary electrode plate into a low impedance.

3. The electrostatic microphone according to claim 2 wherein said supporting member is provided with a recess for receiving said circuit device.

4. The electrostatic microphone according to claim 2 wherein said circuit device has a housing integrally molded with said supporting member.

5. The electrostatic microphone according to claim 1, 2, 3 or 4 which further comprises a printed circuit board having a circuit pattern electrically coupled to said circuit device.

6. The electrostatic microphone according to claim 5 which further comprises an electrically conductive casing containing said diaphragm, said stationary electrode plate and said printed circuit board.

7. The electrostatic microphone according to claim 6 which further comprises an electrically conductive ring contained in said casing for supporting said diaphragm in cooperation with said supporting member.

8. The electrostatic microphone according to claim 5 which further comprises coupling means for coupling together said supporting member and printed circuit board to place said supporting member and printed circuit board in a specified positional relationship.

9. The electrostiatic microphone according to claim 8 wherein said coupling means comprises at least one pin formed on said supporting means and at least one opening formed in said printed circuit board for receiving said pin.

10. The electrostatic microphone according to claim 5 in which said supporting means has at least one first through hole communicated with said air chamber and extending in a direction substantially at right angles with respect to said diaphragm and said stationary electrode plate, and said printed circuit board is provided with at least one second through hole communicated with said first through hole, and which further comprises acoustically resistive means disposed between said first and second through holes.

11. The electrostatic microphone according to claim 1, 2, 3 or 4 in which said supporting member has at least one through hole communicated with said air chamber and extending in a direction substantially at right angles with respect to said diaphragm and said stationary electrode and which further comprises acoustically resistive means disposed on said supporting member to close an opening of said through hole.

12. The electrostatic microphone according to claim 3 wherein said circuit device takes the form of frustum and received in a tapered recess of said supporting member.

13. The electrostatic microphone according to claim 1 which further comprises an electrically conductive ring which cooperates with the annular projection of said supporting member for holding said diaphragm.

14. The electrostatic microphone according to claim 2, 3 or 4 wherein said impedance converting means includes a field effect transistor having a gate electrode with its end shaped wavy for resiliently engaging with said stationary electrode plate.

15. The electrostatic microphone according to claim 2, 3 or 4 wherein said impedance converting means includes a field effect transistor having a gate electrode embedded in said supporting member, a portion of said gate electrode facing said stationary electrode plate being exposed to engage with said stationary electrode plate.

16. An electrostatic microphone comprising:

an electrically conductive diaphragm;

a stationary electrode plate;

a supporting member for supporting said diaphragm substantially in parallel with said stationary electrode plate; and means for defining an air chamber communicated with an air gap between said vibrating diaphragm and said stationary electrode plate at the peripheral portion of said air gap, wherein said supporting member includes a central projection upon which said stationary electrode plate is mounted, a first annular projection surrounding said central projection containing said stationary electrode plate, and a second annular projection surrounding said first projection and adapted to support said diaphragm, said first and second annular projection defining said air chamber.

17. An electrostatic microphone according to claim 16 further comprising an electrically conductive ring which cooperates with said second annular projection of said supporting member to hold said diaphragm.

18. An electrostatic microphone comprising:

an electrically conductive diaphragm;

a stationary electrode plate;

a supporting member for supporting said diaphragm substantially in parallel with said stationary electrode plate; and means for defining an air chamber communicated with an air gap between said vibrating diaphragm and said stationary electrode plate at the peripheral portion of said air gap;

a circuit device having a housing integrally molded with said supporting member and including a field effect transistor impedance converting means having a gate electrode with its end shaped wavy for resiliently engaging said stationary electrode plate, for converting a high impedance of a capacitor constituted by said diaphragm and said stationary electrode plate into a lower impedance.

19. An electrostatic microphone comprising:

an electrically conductive diaphragm;

a stationary electrode plate;

a supporting member for supporting said diaphragm substantially in parallel with said stationary electrode plate, said supporting member including a central projection upon which said stationary electrode plate is mounted, at least one pair of resilient supporting members which are disposed on opposite sides of said stationary electrode plate for holding the same in cooperation with said central projection, and an annular projection surrounding said central projection and adapted to support said vibrating plate, said central and annular projections defining an air chamber communicated with an air gap between said vibrating diaphragm and said stationary electrode plate at the peripheral portion of said air gap.

20. An electrostatic microphone according to claim 19 further comprising an electrically conductive ring which cooperates with the annular projection of said supporting member for holding said diaphragm.

21. An electrostatic microphone comprising:

an electrically conductive diaphragm;

a stationary electrode plate;

a supporting member for supporting said diaphragm substantially in parallel with said stationary electrode plate, said supporting member provided with a recess;

means for defining an air chamber communicated with an air gap between said vibrating diaphragm and said stationary electrode plate at the peripheral portion of said air gap; and a circuit device taking the form of a frustum and received within said recess of said supporting member which is tapered to receive said circuit device, said circuit device including an impedance converting means which is electrically connected to said stationary electrode plate for converting a high impedance of a capacitor constituted by said diaphragm and said stationary electrode plate into a low impedance.

* * * * *